US006467451B1

(12) United States Patent
Volz et al.

(10) Patent No.: US 6,467,451 B1
(45) Date of Patent: Oct. 22, 2002

(54) METHOD FOR OPERATING AN INTERNAL COMBUSTION ENGINE

(75) Inventors: Dieter Volz, Heilbronn; Ernst Wild, Oberriexingen; Juergen Pantring, Schwieberdingen; Lutz Reuschenbach, Stuttgart; Michael Oder, Illingen; Werner Hess; Bernd Roos, both of Stuttgart; Georg Mallebrein, Korntal-Muenchingen; Christian Koehler, Erligheim, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/582,824

(22) PCT Filed: Oct. 28, 1999

(86) PCT No.: PCT/DE99/03435

§ 371 (c)(1),
(2), (4) Date: Aug. 2, 2000

(87) PCT Pub. No.: WO00/26524

PCT Pub. Date: May 11, 2000

(30) Foreign Application Priority Data

Nov. 3, 1998 (DE) ..... 198 50 584

(51) Int. Cl.[7] ..... F02B 17/00
(52) U.S. Cl. ..... 123/295; 123/299
(58) Field of Search ..... 123/295, 299

(56) References Cited

U.S. PATENT DOCUMENTS

| | | | | | |
|---|---|---|---|---|---|
| 5,722,362 | A | * | 3/1998 | Takano et al. | 1233/295 |
| 5,755,198 | A | | 5/1998 | Grob et al. | |
| 5,954,023 | A | * | 9/1999 | Mizuno et al. | 123/295 |
| 5,960,765 | A | * | 10/1999 | Iida et al. | 123/295 |
| 6,032,640 | A | * | 3/2000 | Evans | 123/295 |
| 6,155,227 | A | * | 12/2000 | Shimada et al. | 123/295 |
| 6,161,517 | A | * | 12/2000 | Sans | 1233/295 |
| 6,256,576 | B1 | * | 7/2001 | Wild et al. | 123/295 |
| 6,257,198 | B1 | * | 7/2001 | Harada | 123/295 |

FOREIGN PATENT DOCUMENTS

| | | |
|---|---|---|
| EP | 0849457 | 6/1998 |
| FR | 2758590 | 7/1998 |

* cited by examiner

*Primary Examiner*—Erick Solis
(74) *Attorney, Agent, or Firm*—Walter Ottesen

(57) ABSTRACT

An internal combustion engine, especially for a motor vehicle, is described which is provided with a combustion chamber into which fuel can be injected in at least two operating modes. A control apparatus is provided with which a switchover can be made between the operating modes in dependence upon a desired operating mode. With the control apparatus, an operating-mode request can be determined in dependence upon whether the individual operating modes are in the position to generate the requested torque while maintaining pregiven lambda limits.

8 Claims, 2 Drawing Sheets

METHOD FOR OPERATING AN INTERNAL COMBUSTION ENGINE

FIELD OF THE INVENTION

The invention relates to a method for operating an internal combustion engine especially of a motor vehicle wherein fuel is injected into a combustion chamber in at least two operating modes and wherein there can be a switching between the two operating modes. Likewise, the invention relates to an internal combustion engine especially for a motor vehicle having a combustion chamber into which fuel can be injected in at least two operating modes. The engine has a control apparatus with which a switchover between the modes of operation can be effected.

BACKGROUND OF THE INVENTION

A method of this kind and an engine of this kind are known, for example, from a so-called gasoline direct injection. There, fuel is injected into the combustion chamber of the engine in a homogeneous operation during the induction phase or in a stratified operation during the compression phase. The homogeneous operation is preferably provided for the full-load operation of the engine; whereas, the stratified operation is suitable for the idle operation or part-load operation. In such a direct injecting engine, a switchover is made between the above-mentioned modes of operation, for example, in dependence upon a wanted desired operating mode.

Specific functions are assigned in the control apparatus to the different possible operating states. The desired operating mode results, inter alia, from the particular operating state and/or function of the engine. Thus, the homogeneous operation can, for example, be purposeful for a cold start of the engine. In contrast, the homogeneous operation can be preferable when there is a defect. An operating mode characteristic field can be provided as a further function of the engine and this characteristic field is especially suited for influencing the normal operation of the engine. The control apparatus determines the desired operating mode from this and from further such operating states and/or functions of the engine.

It is now possible that the computing apparatus derives a desired operating mode from the different operating states and/or functions of the engine which, on the one hand, is suited especially for generating the requested desired torque but which, on the other hand, is not in the position to maintain specific pregiven lambda limits. This would lead to a violation of lambda limits and therefore to an unwanted additional consumption of fuel and/or an unwanted increase in toxic substances. Likewise, it is possible that the computing apparatus selects a desired operating mode with which the requested torque cannot even be realized.

SUMMARY OF THE INVENTION

It is an object of the invention to provide a method for operating an internal combustion engine with which a correct operation of the engine is ensured.

The object or task is solved in a method of the above-mentioned type in accordance with the invention in that an operating mode request is determined in dependence upon whether the individual operating modes are in the position to generate the requested torque while maintaining pregiven lambda limits. In an internal combustion engine of the above-mentioned type, the object is realized in that an operating mode request can be determined by the control apparatus in dependence upon whether the individual operating modes are in the position to generate the requested torque while maintaining pregiven lambda limits.

The control apparatus continuously computes which one of the various operating modes of the engine under the instantaneous operating conditions is in the position, on the one hand, to generate the requested desired torque but, on the other hand, can simultaneously maintain the lambda limits pregiven for the particular operating mode. The control apparatus "knows" thereby at each time point which of the operating modes can be utilized for generating the requested desired torque without violating lambda limits. This can be considered by the control apparatus when making the selection of the desired operating mode.

For a consideration of the above type, it can be provided that the operating request according to the invention be coupled to other operating mode requests of other operating states and/or functions of the engine. This coupling can take place in dependence upon priorities. By assigning a correspondingly high priority to the operating mode request according to the invention, it can be ensured that always only such an operating mode is selected by the control apparatus as a desired operating mode which is also in the position to generate the requested desired torque while maintaining the pregiven lambda limits for the particular operating mode.

It can be reliably avoided that the engine is operated in an operating mode which violates the pregiven lambda limits via a determination of those operating modes which are in the position to generate the requested desired torque while maintaining the particular pregiven lambda limits. This defines an improvement of the operation of the engine in view of a reduction of fuel consumption and a reduction of the toxic substances which are generated.

Likewise, it is possible to trigger a switchover of the operating mode in the event it is determined by the invention that the instantaneous operating mode cannot maintain the corresponding pregiven lambda limits. In this way too, a defective operation of the engine is avoided in the sense of a violation of pregiven lambda limits.

In an advantageous embodiment of the invention, a determination is made for each of the operating modes whether this mode is in the position to generate the requested torque and to simultaneously maintain the pregiven lambda limits and the results of these determinations are summarized in a request byte. The request byte defines a most effective compilation of the results of the method of the invention. Likewise, the request byte can be processed by the control apparatus in an especially simple manner.

It is especially advantageous when the determination is carried out in dependence upon operating variables of the engine as to whether an operating mode is in the position to generate the requested torque while maintaining the pregiven lambda limits. Furthermore, a torque is derived from an rpm-dependent characteristic field in the determination as to whether an operating mode is in the position to generate the requested torque while maintaining the pregiven lambda limits.

In an advantageous embodiment of the invention, a switchover of the operating mode is triggered in the event that the instantaneous operating mode does not maintain the pregiven lambda limits corresponding thereto. In this way, an operation of the engine which violates the pregiven lambda limits is reliably avoided.

In a further embodiment of the invention, the operating request is stored in the form of a binary data word in the control apparatus. Each operating mode is represented by a specific bit in the binary data word.

Of special significance is the realization of the method of the invention in the form of a control element which is provided for a control apparatus of an internal combustion engine, especially of a motor vehicle. A program is stored on the control element which can be run on a computing apparatus, especially a microprocessor and is suitable for carrying out the method of the invention. In this case, the invention is therefore realized by a program stored on the control element so that this control element, which is provided with the program, defines the invention in the same manner as the method for the execution of which the program is suitable. As a control element, especially an electrical storage medium can be used such as a read-only-memory.

Additional features, possibilities of application and advantages of the invention result from the description of the embodiments of the invention which follows. The embodiments are shown in the figures of the drawing. All described or illustrated features define the invention by themselves or in any desired combination independently of their combination in the patent claims or their dependency as well as independently of their formulation or description in the disclosure and/or drawings.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
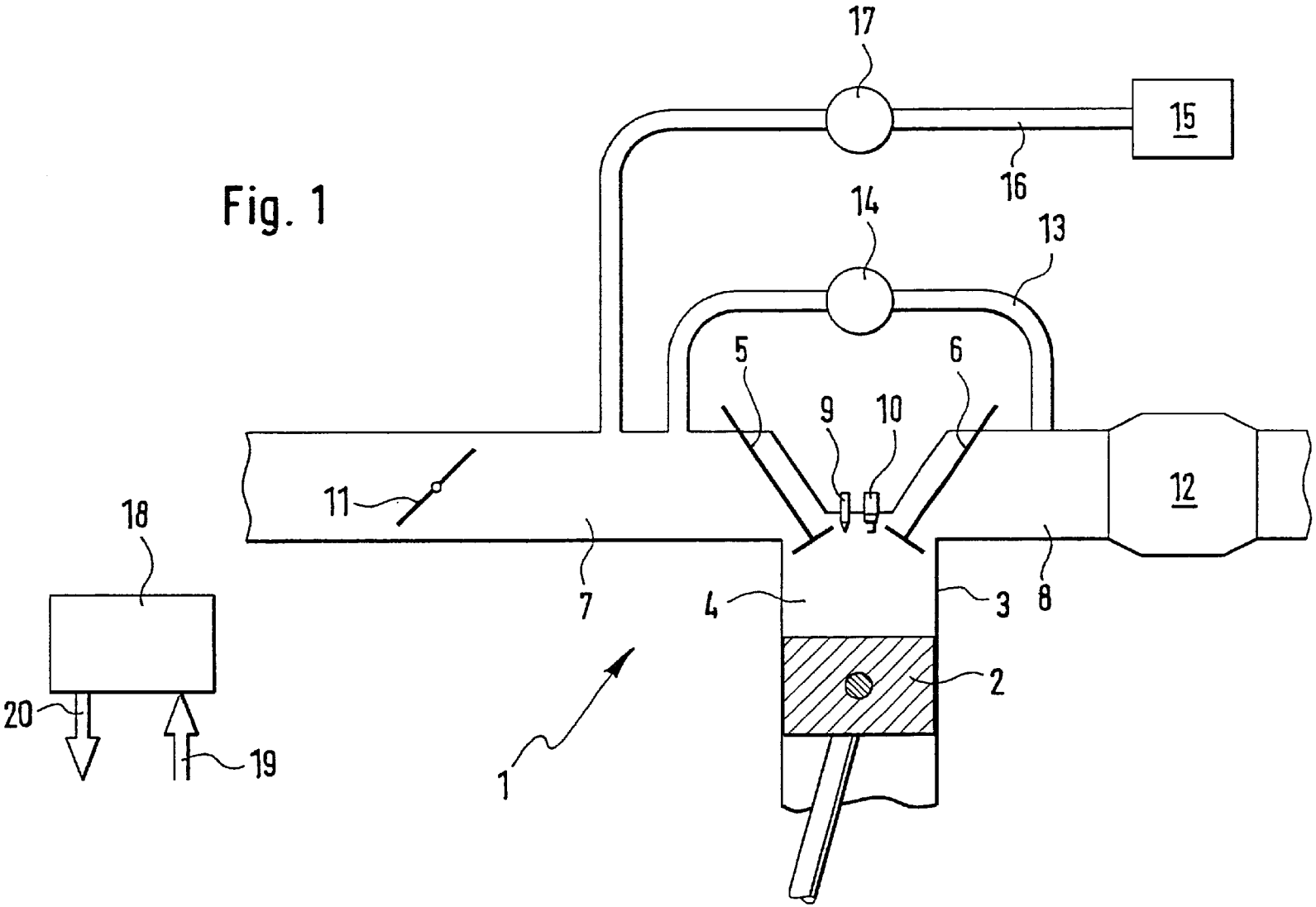
FIG. 1 is a schematic block circuit diagram of an embodiment of the internal combustion engine according to the invention; and, FIG. 2 shows a schematic block circuit diagram of an embodiment of the method of the invention for operating the engine of FIG. 1.

In FIG. 1, an internal combustion engine 1 of a motor vehicle is shown wherein a piston 2 is movable back and forth in a cylinder 3. The cylinder 3 is provided with a combustion chamber 4 which is delimited, inter alia, by the piston 2, an inlet valve 5 and an outlet valve 6. An intake manifold 7 is coupled to the inlet valve 5 and an exhaust-gas pipe 8 is coupled to the outlet valve 6.

An injection valve 9 and a spark plug 10 extend into the combustion chamber 4 in the region of the inlet valve 5 and the outlet valve 6. Fuel can be injected into the combustion chamber 4 via the injection valve 9. The fuel in the combustion chamber 4 can be ignited with the spark plug 10.

A rotatable throttle flap 11 is mounted in the intake manifold 7 and air can be supplied to the intake manifold 7 via this throttle flap. The quantity of the supplied air is dependent upon the angular position of the throttle flap 11. A catalytic converter 12 is mounted in the exhaust-gas pipe 8 and functions to clean the exhaust gas arising because of the combustion of the fuel.

An exhaust-gas recirculation pipe 13 leads back to the intake manifold 7 from the exhaust-gas pipe 8. An exhaust-gas recirculation valve 14 is mounted in the exhaust-gas recirculation pipe 13. The quantity of the exhaust gas recirculated into the intake manifold 7 is adjusted by the valve 14. The exhaust-gas recirculation pipe 13 and the exhaust-gas recirculation valve 14 conjointly define a so-called exhaust-gas recirculation system (EGR).

A tank-venting line 16 leads from the fuel tank 15 to the intake manifold 7. A tank-venting valve 17 is mounted in the tank-venting line 16. With the valve 17, the quantity of the fuel vapor can be adjusted which is supplied to the intake manifold 7 from the fuel tank 15. The tank-venting line 16 and the tank-venting valve 17 conjointly form a so-called tank-venting system.

A back and forth movement is imparted to the piston 2 by the combustion of the fuel in the combustion chamber 4. This movement is transmitted to a crankshaft (not shown) and applies a torque to the crankshaft.

Input signals 19 are applied to a control apparatus 18 and these signals define operating variables of the engine 1 measured by sensors. For example, the control apparatus 18 is connected to an air mass sensor, a lambda sensor, an rpm sensor and the like. Furthermore, the control apparatus 18 is connected to an accelerator pedal sensor which generates a signal that indicates the position of an accelerator pedal, which is actuable by the driver, and therefore indicates the requested torque. The control apparatus 18 generates output signals 20 with which the performance of the engine 1 can be influenced via actuators and/or positioning devices. For example, the control apparatus 18 is connected to the injection valve 9, the spark plug 10 and the throttle flap 11 and the like and generates the signals required for driving the same.

The control apparatus 18 is, inter alia, provided to control (open-loop and/or closed-loop) the operating variables of the engine 1. For example, the fuel mass, which is injected by the injection valve 9 into the combustion chamber 4, is controlled (open-loop and/or closed-loop) by the control apparatus 18 especially to provide a reduced consumption of fuel and/or to provide a reduced generation of toxic substances. For this purpose, the control apparatus 18 is provided with a microprocessor in which a program is stored in a memory medium such as a read-only-memory. This program is suitable to carry out the above-mentioned control (open-loop and/or closed-loop).

In a first operating mode, a so-called homogeneous operation "hom" of the engine 1, the throttle flap 11 is partially opened or closed in dependence upon the desired torque. The fuel is injected into the combustion chamber 4 by the injection valve 9 during an induction phase caused by the piston 2. The injected fuel is swirled by the air inducted simultaneously via the throttle flap 11 and thereby is essentially uniformly distributed in the combustion chamber 4. Thereafter, the air/fuel mixture is compressed during the compression phase in order to then be ignited by the spark plug 10. The piston 2 is driven by the expansion of the ignited fuel. In homogeneous operation, the arising torque is dependent, essentially, on the position of the throttle flap 11. The air/fuel mixture is adjusted as close as possible to $\lambda=1$ or to $\lambda<1$ to obtain a reduced generation of toxic substances.

In a second operating mode, a so-called homogeneous lean operation "hmm" of the engine 1, the fuel is injected into the combustion chamber 4 during the induction phase as in the homogeneous operation. In contrast to the homogeneous operation, the air/fuel mixture can, however, also occur with $\lambda>1$.

In a third operating mode, a so-called stratified operation "sch" of the engine 1, the throttle flap 11 is opened wide. The fuel is injected into the combustion chamber 4 by the injection valve 9 during a compression phase caused by the piston 2. This injection is spatially in the immediate vicinity of the spark plug 10 as well as at a suitable interval in time ahead of the ignition time point. Then, with the aid of the spark plug 10, the fuel is ignited so that the piston 2 is driven in the following work phase by the expansion of the ignited fuel. The resulting torque is dependent in stratified operation substantially from the injected fuel mass. Essentially, the stratified operation is provided for the idle operation and for the part-load operation of the engine 1.

In a fourth operating mode, a so-called homogeneous stratified operation "hos" of the engine 1, a double injection takes place. Fuel is injected into the combustion chamber 4 by the injection valve 9 during the induction phase and during the compression phase. The homogeneous stratified operation thereby couples the characteristics of the stratified operation and the homogeneous operation. With the aid of the homogeneous-stratified operation, an especially soft transition from the stratified operation into the homogeneous operation and vice versa can be obtained.

A double injection likewise takes place in a fifth operating mode, a so-called stratified catalytic converter heating mode "skh" of the engine 1. Fuel is injected into the combustion chamber 4 by the injection valve 9 during the compression phase and during the work phase. In this way, essentially no additional torque is obtained; instead, a rapid warming of the catalytic converter 12 is effected by the fuel injected in the work phase. This is of significance especially for a cold start of the engine 1.

A switchover back and forth between the described operating modes of the engine 1 can be provided. Switchovers of this kind are executed by the control apparatus 18. The triggering of a switchover takes place via functions of the engine 1. For example, for a cold start, the fifth operating mode (namely, the stratified catalytic converter heating mode) can be requested and, with this mode, the catalytic converter 12 is heated rapidly to an operating temperature.

In the engine 1, a plurality of such functions is present which all request a specific operating mode of the engine 1 or even several of the operating modes of the engine and thereby, if required, trigger a switchover between the operating modes. For example, respective requests for specific operating modes can be triggered, for example, by a monitoring of the engine 1 or by an emergency operation for the engine 1 or by a function for the start and/or for the warm running of the engine. As additional functions, the adjustment of the desired torque and the maintenance of the lambda limits is monitored and guaranteed in this context. For this purpose, it is continuously determined which one of the described operating modes under the instantaneously present operating conditions of the engine 1 is in the position to generate the requested desired torque and simultaneously maintain the pregiven lambda limits.

Figure 2:
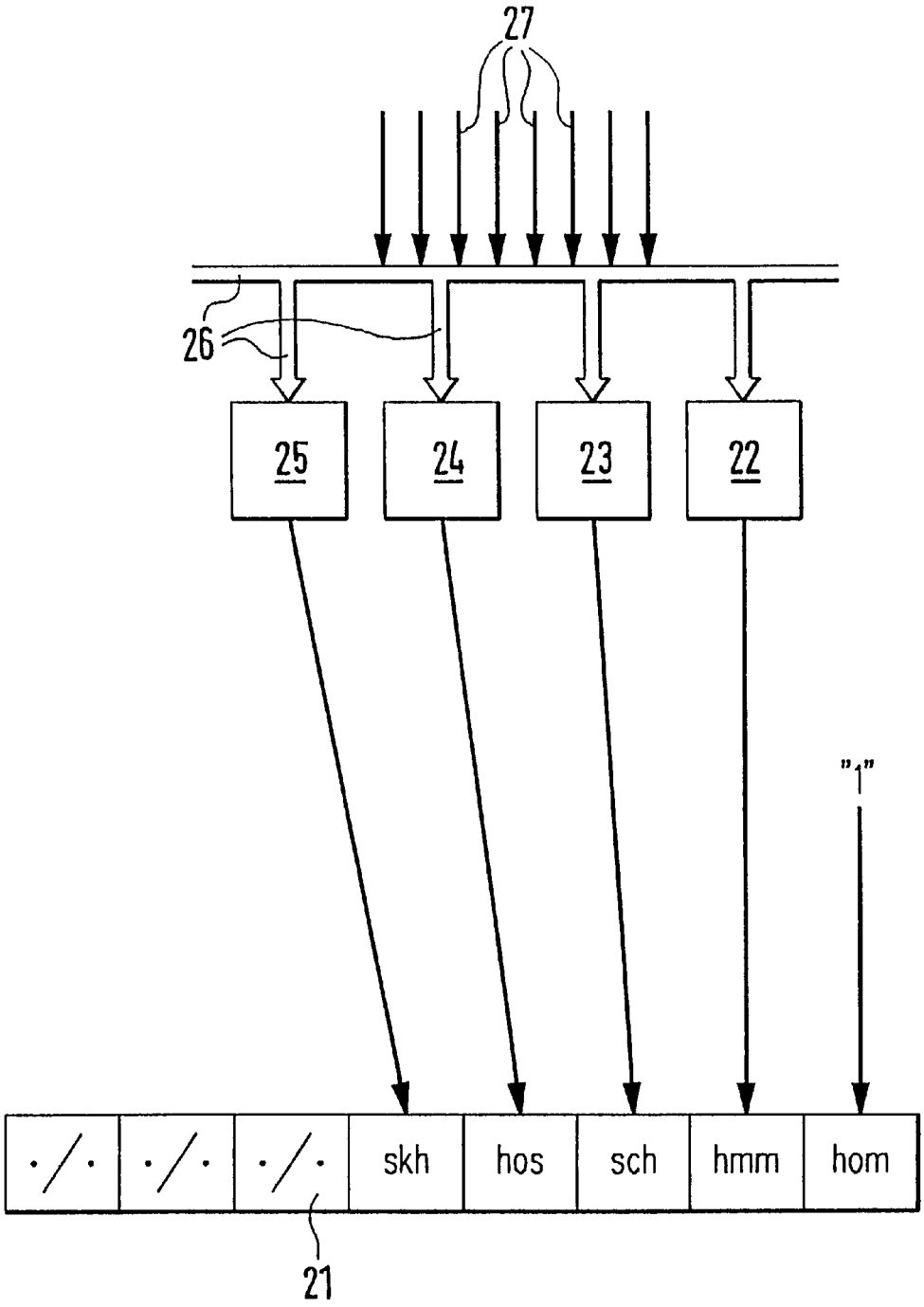

In FIG. 2, a method is shown which can be executed by the control apparatus 18 and this method is suitable to execute the determination of the operating modes which are suitable for the generation of the requested torque. The method of FIG. 2 is represented in the control apparatus 18 by especially modular-like built-up programs.

The method shown in FIG. 2 proceeds from a desired byte which serves to store the described operating modes of the engine 1 in the control apparatus 18. The desired byte has eight bits of which three bits are not occupied. Here, it is noted that the engine 1, which is described with respect to FIG. 1, and the method, which is described with respect to FIG. 2, can be carried out also with fewer or with more than five different operating modes. In this case, more or less bits are not occupied in the desired byte.

The following are each represented by corresponding ones of the remaining five bits: the homogeneous operation "hom", the homogeneous lean operation "hmm", the stratified operation "sch", the homogeneous stratified operation "hos" and the stratified catalytic converter heating "skh".

The above-mentioned desired byte is provided to characterize the desired operating mode, that is, the wanted operating mode of the engine 1. If the engine 1 is to be operated, for example, in the homogeneous operation as the wanted desired operating mode, then the bit "hom" is set to "1" in the desired byte; whereas, the other four relevant bits are all set to "0". Accordingly, in the desired byte, always one of the relevant bits is set to "1"; whereas, the other bits are set to "0". The bit, which is set to "1", characterizes the wanted desired operating mode of the engine 1.

The desired byte, especially the desired operating mode set therein, is determined by the computing apparatus 18 on the basis of request bytes. These request bytes are generated by the different functions already mentioned. One of these functions is, as already mentioned, provided for the purpose of ensuring the adjustment of the desired torque and the maintenance of the lambda limits. From this function, it is continuously determined which one of the operating modes is, under the instantaneously present operating conditions of the engine 1, in the position to generate the requested desired torque and to simultaneously maintain the pregiven lambda limits.

In the method of FIG. 2, the premise is taken that the various operating functions each generate operating mode requests. These operating mode requests are triggered by each of the functions with a corresponding request byte corresponding to the desired byte. In this request byte, the individual bits correspond to the corresponding bits of the desired byte.

In the request byte, at least one bit is set to "1". However, all five bits can be set. In the first case, this means that the corresponding function only requests this operating mode which is fixed by the set bit. In the other case, it is unessential for the corresponding function which operating mode is present. The corresponding function therefore requests "pro forma" all possible operating modes. All possibilities lying therebetween are likewise permissible. For example, in this way, the homogeneous operation can be requested by a function independently of the lambda value to be set. In this case, the bit for "hom" and for "hmm" are each set to "1" in the corresponding request byte; however, the other bits are set to "0".

The desired byte and the request bytes are binary data words which are stored in the control apparatus 18 and wherein each operating mode is represented by a specific bit. It is to be noted that the desired byte and the request bytes have, as described, different meanings and therefore must be clearly distinguished from each other.

In FIG. 2, the request byte is shown for the already mentioned function which is provided in order to adjust the desired torque and to ensure the maintenance of the lambda limits. This request byte is provided with the reference numeral 21. As already mentioned, three of the bits have no significance. The bit "hom" is always set to "1" because the homogeneous operation "hom" of the engine 1 is suitable for generating all possible desired torques under all operating conditions without violating the pregiven lambda limits.

The other four relevant bits are generated by blocks 22, 23, 24 and 25. These blocks are connected via line and/or bus systems 26 to a plurality of operating variables of the engine 1. The operating variables can be output signals of sensors, control variables for actuators or positioning devices, other quantities derived or computed by the control apparatus 18 or the like. The operating variables of the engine 1 are identified in FIG. 2 by the reference numeral 27.

Each of the blocks 22, 23, 24 and 25 is assigned to a specific operating mode via its connection to a specific bit of the request byte. In each of the blocks 22, 23, 24 and 25, the computing apparatus 18 continuously determines whether the operating mode, which corresponds to the block, is, under the instantaneously present operating conditions of the engine 1, in the position to generate the desired torque requested especially by the driver via the accelerator pedal and to simultaneously maintain the lambda limits provided for this operating mode.

For this purpose, a minimum and/or maximum lambda efficiency is computed by the blocks 22, 23, 24 and 25 from the lambda limits pregiven for the corresponding operating mode. Likewise, an optimal torque for the air charge, which is to be adjusted in this operating mode, is derived from an rpm-dependent characteristic field, which is specific to the operating mode. A multiplication of the lambda efficiency and of the optimal torque yields a minimum and/or maximum possible torque in the corresponding operating mode. The operating mode can generate the requested desired torque and simultaneously maintain the pregiven lambda limits when the wanted requested desired torque lies within the limits of this minimum and/or maximum possible torque. If the desired torque lies outside of the minimum and/or maximum possible torque, then the engine could generate, if at all, the desired torque only in that the lambda limits, which are pregiven for the then present operating mode, are violated.

Each of the blocks 22, 23, 24 and 25 sets the bit, which can be influenced by this block, to "1" in the request byte 21 when the corresponding operating mode is in the position to generate the requested torque and to maintain the operating-mode dependent lambda limits. If this is not the case, then the corresponding block sets the corresponding bit to "0".

As already explained, there is at least one bit in the request byte 21, that is, at least the bit "hom", set for the homogeneous operation. However, it is also possible that two or several bits in the request byte 21 are set. This can, for example, be the case in the part-load operation of the engine 1 which can be executed by the homogeneous operation "hom" but also, for example, by the homogeneous lean operation "hmm", the homogeneous stratified operation "hos" and the stratified operation "sch".

As already mentioned, a plurality of operating-mode requests of different functions and therefore a plurality of request bytes are present in the computing apparatus 18. The computing apparatus 18 determines the desired byte and therefore the operating mode of the engine 1 from these request bytes. This determination is executed by the computing apparatus 18 on the basis of priorities which are assigned to the individual operating-mode requests and therefore to the individual request bytes.

It is possible to provide the request byte 21 with a priority in such a manner that it, on the one hand, is subordinated relative to special functions of the engine 1 such as the emergency operation and that it, however, on the other hand, has priority with respect to the normal functions of the engine 1, especially to the operation of the engine 1 via an operating-mode characteristic field. In this way, it is prevented that, for example, an operating mode is selected by the operating-mode characteristic field which, under the instantaneous operating conditions of the engine 1, can provide the requested torque only while violating the lambda limits pregiven for this operating mode.

In the last-mentioned case, the subordinated request byte of the operating-mode characteristic field is overridden by the higher priority of the request byte 21. Accordingly, not the operating mode, which is specified by the request byte of the operating-mode characteristic field, is selected as the desired operating mode; instead, an operating mode is selected which is pregiven by the request byte 21. In this way, a defective condition of the engine 1 is avoided, especially an operation of the engine 1 violating the pregiven lambda limits.

Likewise, it is possible that a switchover of the operating mode is triggered in the event that it is determined by the invention that the instantaneous operating mode cannot maintain the corresponding pregiven lambda limits. In this case, that bit is set to "0" in the request byte 21 which is assigned to the instantaneously executed operating mode. This can be detected by the control apparatus 18 and be used to trigger a change of the operating mode.

What is claimed is:

1. A method for operating an internal combustion engine including an engine of a motor vehicle, the method comprising the steps of:

injecting fuel into a combustion chamber of said engine in at least two operating modes;

determining an operating-mode request in dependence upon whether the individual operating modes are in the position to generate the requested torque while maintaining pregiven lambda limits; and, executing a switchover between the operating modes.

2. The method of claim 1, comprising the further steps of:

for each of the operating modes, determining whether this operating mode is in the position to generate the requested torque and to simultaneously maintain the pregiven lambda limits; and, compiling the results of the determination in a request byte.

3. The method of claim 1, wherein the determination as to whether an operating mode is in the position to generate the requested torque while maintaining the pregiven lambda limits is executed in dependence upon operating variables of the engine.

4. The method of claim 3, wherein, in the determination as to whether an operating mode is in the position to generate the requested torque while maintaining the pregiven lambda limits, a torque is derived from an rpm-dependent characteristic field.

5. The method of claim 1, comprising the further step of triggering a switchover of the operating mode in the event that the instantaneous operating mode does not maintain the corresponding pregiven lambda limits.

6. A control element including a read-only-memory for a control apparatus of an internal combustion engine including an engine of a motor vehicle, the control element comprising a program stored thereon which can be run on a computing apparatus including a microprocessor for carrying out a method including the steps of: injecting fuel into a combustion chamber of said engine in at least two operating modes; determining an operating-mode request in dependence upon whether the individual operating modes are in the position to generate the requested torque while maintaining pregiven lambda limits; and, executing a switchover between the operating modes.

7. An internal combustion engine including an engine for a motor vehicle, the engine comprising:

a combustion chamber;

means for injecting fuel into the combustion chamber in at least two operating modes;

a control apparatus for switching over between the operating modes; and, means for determining an operating-mode request by the control apparatus in dependence upon whether the individual operating modes are in the position to generate the requested torque while maintaining the pregiven lambda limits.

8. The internal combustion engine of claim 7, further comprising: means for storing the operating-mode request in the control apparatus in the form of a binary data word and each operating mode being represented by a specific bit in the binary data word.

* * * * *